US008517498B2

(12) United States Patent
Makita et al.

(10) Patent No.: US 8,517,498 B2
(45) Date of Patent: Aug. 27, 2013

(54) LIQUID EJECTING APPARATUS AND CONTROL METHOD OF LIQUID EJECTING APPARATUS

(75) Inventors: Shushi Makita, Matsumoto (JP); Kinya Ozawa, Shiojiri (JP); Ryoichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/081,459

(22) Filed: Apr. 6, 2011

(65) Prior Publication Data

US 2011/0249053 A1 Oct. 13, 2011

(30) Foreign Application Priority Data

Apr. 13, 2010 (JP) ..... 2010-092364

(51) Int. Cl.
*B41J 29/38* (2006.01)

(52) U.S. Cl.
USPC ..... 347/17

(58) Field of Classification Search
CPC ..... B41J 2/17593; B41J 1/008
USPC ..... 347/9, 10, 14, 17, 19
See application file for complete search history.

(56) References Cited

U.S. PATENT DOCUMENTS 5,331,340 A * 7/1994 Sukigara ..... 347/14
2009/0322816 A1 12/2009 Ihara

FOREIGN PATENT DOCUMENTS

JP 2010-030313 A 2/2010

* cited by examiner

*Primary Examiner* — An Do
(74) *Attorney, Agent, or Firm* — Kilpatrick Townsend & Stockton LLP

(57) ABSTRACT

Liquid ejecting apparatus and control methods thereof are disclosed. A liquid ejecting apparatus includes an ejecting head having liquid-ejecting nozzles, a platen disposed to support a recording medium and face the ejecting head, a heater that heats the platen, a temperature sensor to detect a temperature of the ejecting head, and a control section that causes liquid to be ejected from the nozzles. If a change in a temperature of the ejecting head and/or a temperature of the ejecting head exceeds a predetermined range, the control section stops ejection of liquid for printing from the nozzles in the absence of a user input to continue printing. After the control section stops the ejection of liquid, a response process can be carried out.

20 Claims, 6 Drawing Sheets

LIQUID EJECTING APPARATUS AND CONTROL METHOD OF LIQUID EJECTING APPARATUS

This application claims priority to Japanese Application No. 2010-092364, filed Apr. 13, 2010, the entirety of which is incorporated by reference herein.

BACKGROUND

1. Technical Field

The present invention relates generally to a liquid ejecting apparatus such as an ink jet type printer and a control method thereof, and more particularly to a liquid ejecting apparatus having a heater that heats an ejection target, and a control method thereof.

2. Related Art

A typical liquid ejecting apparatus has a liquid ejecting head with nozzles operable to eject various liquids. As a representative example of a liquid ejecting apparatus, for example, image recording apparatuses can be given such as ink jet type printers (hereinafter simply referred to as printers), which are provided with ink jet type recording heads (hereinafter simply referred to as recording heads and can also be referred to as liquid ejecting heads which eject ink in the form of a liquid) and perform recording of an image or the like by ejecting and landing ink in the form of liquids from nozzles of the recording head onto a recording medium (an landing target) such as recording paper. Liquid ejecting apparatus are not limited to image recording. For example, in recent years, liquid ejecting apparatus have also been used in manufacturing, such as in manufacturing of a color filter of a liquid crystal display or the like.

Recently, printers have been used for instances of performing printing on recording media larger than the printing paper typically used with a general home printer, for example, outdoor advertisements or the like. As the recording medium in this case, a resin film made of, for example, vinyl chloride can be used to provide weather resistance. A solvent ink containing an organic solvent as its main component can be used to print on such a resin film. The solvent ink is excellent in scratch resistance and weather resistance, compared to water-based ink.

Incidentally, since it is hard for the resin film to absorb ink, there is a risk of a recorded image bleeding. In order to cope with such a problem, the use of a heater (a platen heater) to heat a recording medium on a platen has been proposed, in which drying and fixing of ink landed on recording paper are promoted by heating of the recording paper by the heater (refer to JP-A-2010-30313, for example).

In the case of printing an advertisement or the like that is even larger than the maximum size of a recording medium capable of being printed by a printer, the advertisement can be partially printed on a roll-shaped film, the film cut and divided after printing into the respective parts, and the respective parts can be joined together, thereby creating one sheet of continuous finished product. When, however, a recording medium is heated by the above-described heater, heat from the heater is transmitted to a recording head, whereby the viscosity of the ink changes over time. In general, an increase in temperature of the inside of the recording head lowers the viscosity of the ink. If the viscosity of the ink is lowered, the amount (weight or volume) of ink ejected at a given pressure is increased. That is, the ejection characteristics change in accordance with the temperature. Accordingly, there is a risk of the density of an image printed on the film vary undesirably. As described above, where respective printed parts of an image are joined into one sheet, there is a problem where differences in density are conspicuous at the boundary portions, thereby resulting in poor image quality. And when the temperature of the inside of the recording head is low at the start of the printing relative to the steady state temperature of the recording head, the resulting temperature change can easily cause the above-mentioned problem.

SUMMARY

An advantage of some aspects of the invention is that it provides a liquid ejecting apparatus in which it is possible to suppress a variation in ejection characteristics accompanying a change in temperature, and a control method of a liquid ejecting apparatus.

According to a first aspect of the invention, there is provided a liquid ejecting apparatus including: a recording head in which nozzles, from which liquid is ejected, are provided; a platen provided to face the recording head; a heater that heats the platen; a temperature sensor that detects the temperature of the recording head; and a control section that causes liquid to be ejected from the nozzles, wherein, if at least one of a change in temperature of the recording head or the temperature of the recording head that exceeds a predetermined range is detected by the temperature sensor, the control section stops the ejection of liquid for printing from the nozzles.

In addition, the "change in temperature" in the "change in temperature and the temperature" means the difference between the temperature detected previously and the temperature detected currently and "the temperature" means the value of the detected temperature itself.

According to the above aspect of the invention, the control section determines whether or not a detected temperature by the temperature detection section is within a predetermined range (of at least one of a change in temperature or the temperature) during an process of ejecting (ejection for printing) a liquid by the recording head, and in a case where the detected temperature is outside the predetermined range, since ejection of a liquid for printing from the nozzles is stopped, variation in ejection characteristics (ejection amount, ejection velocity, formation of a satellite, or the like) accompanying a change in temperature can be prevented before it happens, so that variation in density of an image or the like printed on the recording medium can be suppressed.

In addition, a configuration may be made such that if the detected temperature returns to a temperature within the predetermined range, printing by ejection of liquid is automatically resumed.

Also, in the above case, a configuration may be made such that the temperature detection section detects the temperature of the recording head in the period after the recording head moves relatively with respect to the platen, thereby coming beyond a printing area and before the recording head enters into the printing area again with the relative movement direction reversed and a driving waveform generation section performs generation of a driving waveform in the period before the recording head enters into the printing area.

Also, a configuration may be made such that the temperature detection section performs the temperature detection when the relative movement of the recording head while reversing the relative movement direction after moving outside the printing area with respect to the platen, is stopped.

In the above case, in a case where at least one of a change in temperature or the temperature of the recording head detected by the temperature detection section does not exceed the predetermined range, the control section may change and supply a driving waveform, which ejects the liquid from the nozzles, in accordance with the detected temperature, thereby making the liquid be ejected from the nozzles.

In doing so, it is possible to maintain an almost constant image density or the like without a significant change in the liquid ejection characteristics, by a changing of a driving waveform. In the changing of a driving waveform, it is preferable if ejection of a liquid for printing is stopped in cases where a roughly constant image density or the like cannot be maintained.

Also, in the above case, the control section may perform ejection control of the liquid so as to perform ejection of a liquid that is not for printing, after the stopping of the ejection of the liquid for printing from the nozzles.

By ejecting liquid having a temperature outside of the predetermined range, some or all of the liquid in the vicinity of the nozzles is replaced with liquid having a temperature within the predetermined range or a temperature close to a temperature in the predetermined range, and the temperature of the displaced liquid becomes (or is brought close to) the temperature in the vicinity of the nozzles.

Ejection of the liquid which is not for printing may be performed by a so-called flushing which ejects liquid beyond the printing area in order to restore liquid ejection capability.

In addition, an "ejection capability restoration process" means a process for forcibly ejecting thickened liquid or air bubbles from the nozzles for the purpose of restoring the ejection characteristics (amount or flying velocity of the ejected liquid) lowered due to the thickening of liquid or retention of air bubbles to a design target value.

Also, in the above aspect, the recording head may be controlled so as to wait beyond the printing area (even an area which does not face the platen) after ejection of the liquid for printing from the nozzles is stopped by the control section.

By doing so, the liquid can be prevented from being erroneously ejected onto the recording medium.

Also, since at least one of a change in temperature or the temperature of the recording head exceeding a predetermined range is, in many cases, due to a change in temperature or the temperature of the recording head exceeding a predetermined range due to the heat of the platen heated by the heater, the head can be cooled by making the recording head wait at a position other than a position which faces the platen.

In the above aspect, the liquid ejecting apparatus may further include a selection request section which, after the ejection of the liquid for printing from the nozzles is stopped by the control section, makes a request on a user of the liquid ejecting apparatus to select whether or not printing is to be continued after cancelling the stopping of liquid ejection.

In doing so, liquid ejection is stopped temporarily, whereby continuation of printing in which a problem arises in the shading or the like of an image is stopped. However, in a case where a user wants to finish printing quickly in spite of some problems in the shading of images, or a case where a user determines that the printing is for a purpose in which the shading of the image does not matter, or the like, it is possible to select whether or not printing is to be continued after cancelling the stopping of liquid ejection at the user's discretion.

Also, in the above aspect, the liquid ejecting apparatus may further include a selection request section which, before ejection of the liquid for printing from the nozzles is stopped by the control section, makes a request to a user to select whether or not printing is continued without the stopping of liquid ejection.

In doing so, in a case where a user wants to finish printing quickly in spite of some problems in the shading of images, or a case where a user determines that the printing is of a purpose in which the shading of images does not matter, or the like, it is possible to continue printing without the stopping of liquid ejection.

Also, according to a second aspect of the invention, there is provided a control method of a liquid ejecting apparatus which includes a recording head in which nozzles, from which liquid is ejected, are provided; a platen provided to face the recording head; a heater which heats the platen; a temperature detection section which detects the temperature of the recording head; and a control section which makes the liquid be ejected from the nozzles, the method including: determining whether or not at least one of a change in temperature or the temperature of the recording head by the temperature detection section has exceeded a predetermined range; and making the control section stop the ejection of liquid for printing from the nozzles if it is outside the predetermined range.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the best mode for carrying out the invention will be described with reference to the accompanying drawings. In addition, although in embodiments which are described below, various limitations are given as preferred specific examples of the invention, the scope of the invention is not to be limited to these aspects unless the description of an intent to limit the invention is particularly provided in the following explanation. Also, in the following, as a liquid ejecting apparatus according to the invention, an ink jet type recording apparatus (hereinafter referred to as a printer) is taken as an example. Although in the following examples, an ink jet printer which ejects ink by using a piezoelectric vibrator is taken and described as an example, a liquid ejecting apparatus which performs boiling by applying heat to liquid and ejects ink by using that force may also be adopted. Also, not only a configuration in which a recording head moves with respect to a platen, but also a configuration in which the platen side moves with respect to a recording head may be adopted.

Figure 1:
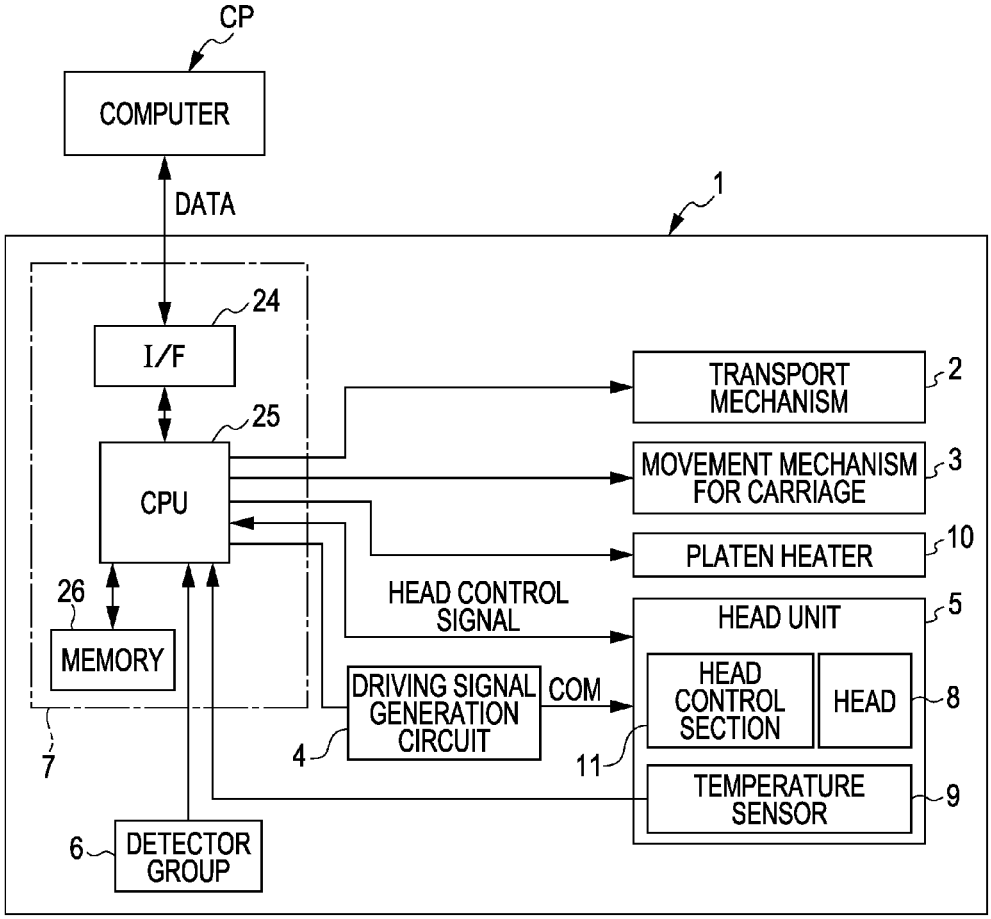
FIG. 1 is a block diagram explaining the electrical configuration of a printer in accordance with an embodiment.
Figure 2A:
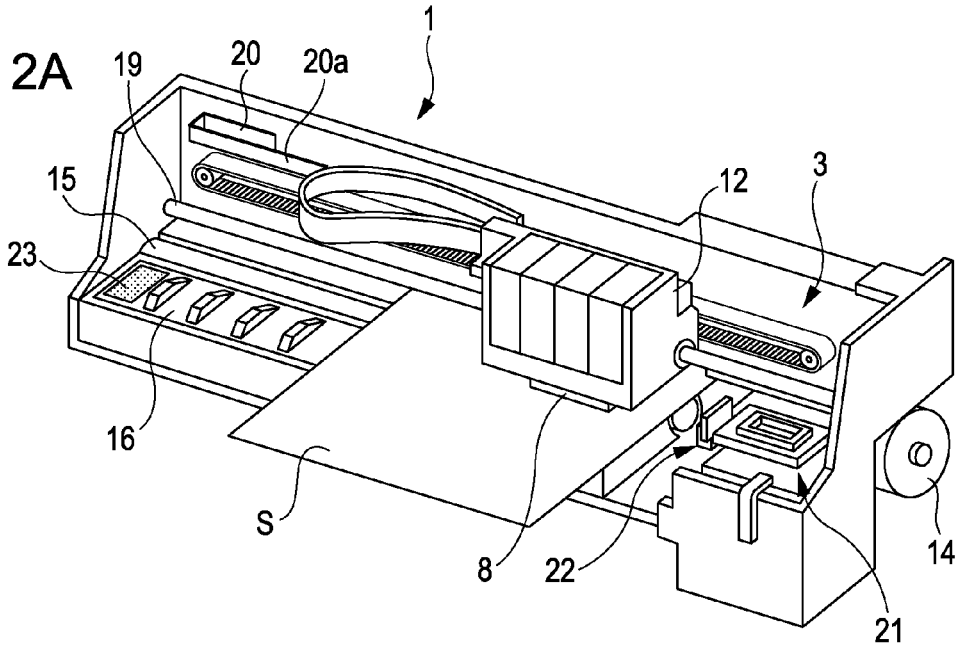
FIGS. 2A to 2C are views explaining the internal configuration of the printer of FIG. 1.
Figure 2B:
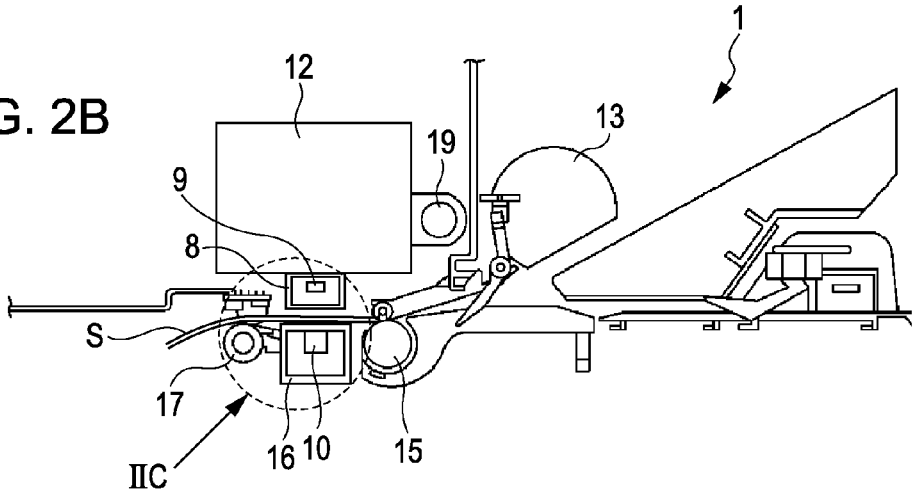
Figure 2C:
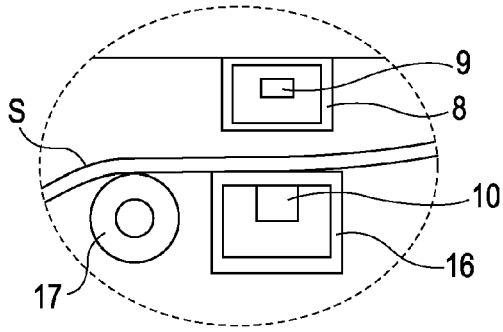

FIG. 1 is a block diagram explaining the electrical configuration of a printer 1. Also, FIGS. 2A to 2C are views explaining the internal configuration of the printer 1, wherein FIG. 2A is a perspective view, and FIG. 2B is a transverse cross-sectional view.

The illustrated printer 1 ejects ink, which is one type of liquid, toward a recording medium S such as recording paper, cloth, or a resin film. The recording medium S is a landing target which becomes a target, on which liquid is ejected and landed. A computer CP as an external device is connected to the printer 1 so as to be able to communicate therewith. In order to make the printer 1 print an image, the computer CP transmits printing data according to the image to the printer 1.

The printer 1 in this embodiment includes a transport mechanism 2, a movement mechanism for carriage 3 (one type of a movement section), a driving signal generation circuit 4 (one type of a driving waveform generation section), a head unit 5, a detector group 6, a platen heater 10, and a printer controller 7. The transport mechanism 2 transports the recording medium S in a transport direction. The movement mechanism for carriage 3 moves a carriage, on which the head unit 5 is mounted, in a given movement direction (for example, a paper-width direction). The driving signal generation circuit 4 includes a DAC (Digital Analog Converter, not shown) and generates an analog voltage signal on the basis of waveform data relating to the waveform of a driving signal sent from the printer controller 7. Also, the driving signal generation circuit 4 also includes an amplifier circuit (not shown) and power-amplifies a voltage signal from the DAC, thereby generating a driving signal COM. The driving signal COM (the driving waveform) is applied to a piezoelectric vibrator 32 (refer to FIG. 3) of a recording head 8 at the time of a printing process (a recording process or an ejecting process) on the recording medium and is a successive signal which includes at least one or more of ejection pulse PS in a unit period that is a repetition period of the driving signal COM, as shown as one example in FIGS. 4A and 4B. Here, the ejection pulse PS is for making a given operation be performed in the piezoelectric vibrator 32 in order to eject ink of a droplet shape from the recording head 8. In addition, the details of the ejection pulse PS will be described later.

Figure 3:
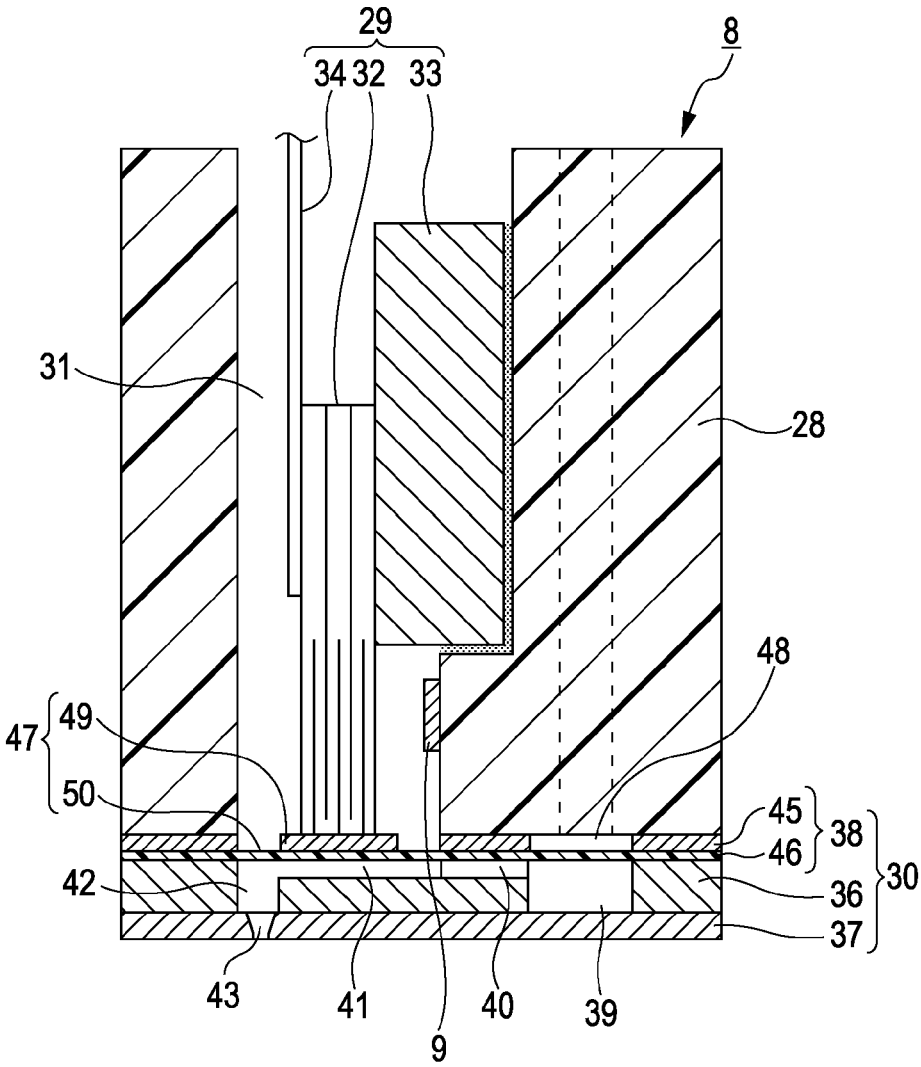
FIG. 3 is a cross-sectional view of a main section of a recording head in accordance with an embodiment.

The head unit 5 includes the recording head 8, a head control section 11, and a temperature sensor 9 (one type of a temperature detection section). The recording head 8 is one type of a liquid ejecting head and ejects ink toward the recording medium, thereby making it land on the recording medium, thereby forming a dot. An image or the like is recorded on the recording medium S by arranging the plurality of dots in a matrix form. The head control section 11 controls the recording head 8 on the basis of a head control signal from the printer controller 7. The temperature sensor 9 is constituted by a thermistor and provided in a storage hollow portion 31 of a case 28 of the recording head 8, as shown in FIG. 3. The temperature sensor 9 detects the temperature of the inside of the recording head 8 and outputs a detection signal to a CPU 25 side of the printer controller 7 as temperature information. In addition, the configuration of the recording head 8 will be described later. The detector group 6 is constituted by a plurality of detectors which monitors the condition of the printer 1. Detection results by these detectors are output to the printer controller 7. The printer controller 7 serves as a control section in the invention and performs overall control in the printer 1.

The transport mechanism 2 is a mechanism for transporting the recording medium S in a direction (hereinafter referred to as a transport direction) perpendicular to the scanning direction of the recording head 8. The transport mechanism 2 includes a paper feed roller 13, a transport motor 14, a transport roller 15, the platen 16, and a paper discharge roller 17. The paper feed roller 13 is a roller for feeding the recording medium S into the printer. The transport roller 15 is a roller which transports the recording medium S fed by the paper feed roller 13, up to above the platen 16 that is a printable area, and is driven by the transport motor 14. The platen 16 supports the recording medium S during printing. The platen 16 has a platen heater 10 in the inside thereof. The paper discharge roller 17 is a roller which discharges the recording medium S to the outside of the printer, and is provided on the downstream side in the transport direction with respect to the printable area. The paper discharge roller 17 rotates in synchronization with the transport roller 15.

The printer controller 7 is a control unit for performing control of the printer. The printer controller 7 includes an interface section 24, the CPU 25, and a memory 26. The interface section 24 performs transmission and reception of status data of the printer, such as the sending of printing data or printing instructions from the computer CP to the printer 1 and the receiving of status information of the printer 1 by the computer CP or the like, between the computer CP that is an external device and the printer 1. The CPU 25 is an arithmetic processing device for performing control of the entire printer. The memory 26 is for securing an area which stores a program of the CPU 25, a working area, or the like and includes a storage element such as a RAM or an EEPROM. The CPU 25 controls each unit in accordance with a program stored in the memory 26.

The platen heater 10 is a device for heating the recording medium S which passes over the platen 16. The platen heater 10 is connected to the printer controller 7, starts heating when the printer 1 is turned on, and is controlled so as to reach a predetermined temperature (for example, in the range of 40° C. to 50° C.). The platen heater 10 is provided at a position that faces the recording head 8, which will be described later, and is made so as to be able to heat the recording medium S which passes over the platen 16, by heating the platen 16. Also, the platen heater 10 is equivalent to a heater in the invention.

As shown in FIGS. 2A to 2C, a carriage 12 is mounted in a state where it is supported on a guide rod 19 provided to extend in a main scanning direction, and is constituted so as to reciprocate in the main scanning direction perpendicular to the transport direction of the recording medium S along the guide rod 19 by an operation of the movement mechanism for carriage 3. A position in the main scanning direction of the carriage 12 is detected with use of a linear encoder 20 and a detection signal thereof, that is, an encoder pulse (one type of position information) is transmitted to the CPU 25 of the printer controller 7. The linear encoder 20 is one type of a position information output section and outputs an encoder pulse according to a scanning position of the recording head 8 as position information in the main scanning direction. The linear encoder 20 in this embodiment includes a scale 20*a* (encoder film) provided inside a housing of the printer 1 so as to extend in the main scanning direction, and a photo-interrupter (not shown) mounted on the back face of the carriage 12. The scale 20*a* is a strip-shaped (band-shaped) member made of a transparent resin film, and is, for example, a member in which a plurality of opaque stripes, which traverses in a band-width direction, is printed on the surface of a transparent base film. The respective stripes have the same width and are formed at a constant pitch, for example, a pitch equivalent to 180 dpi, in the band-length direction. Also, the photo-interrupter is constituted by a pair of light-emitting element and light-receiving element, which is disposed to face each other, and is made so as to output an encoder pulse in accordance with the difference between the light-receiving state in a transparent portion of the scale 20*a* and the light-receiving state in a stripe portion.

Since the stripes having the same widths are formed at a constant pitch, if the movement velocity of the carriage 12 is constant, the encoder pulses are output at regular intervals, whereas, in a case where the movement velocity of the carriage 12 is not constant (during acceleration or during deceleration), an encoder pulse interval varies according to the movement velocity of the carriage. Then, the encoder pulse is input to the CPU 25. For this reason, the CPU 25 can recognize a scanning position of the recording head 8 mounted on the carriage 12 on the basis of the received encoder pulse. That is, for example, by counting the received encoder pulses, it is possible to recognize the position of the carriage 12. Accordingly, the CPU 25 can control a recording operation of the recording head 8 while recognizing the scanning position of the carriage 12 (the recording head 8) on the basis of the encoder pulse from the linear encoder 20.

At an end area (the area to the front right side in FIG. 2A) beyond a recording area in the movement range of the carriage 12, a home position which becomes the base point of the scanning of the carriage is set up. At the home position in this embodiment, a capping member 21 which seals a nozzle formation face (a face on an ejection side of a nozzle plate 37; refer to FIG. 3) of the recording head 8, and a wiper member 22 for wiping the nozzle formation face are disposed. Then, the printer 1 is configured so as to be able to perform a so-called bi-directional recording process (a printing process or ejecting process) which records a character, an image, or the like on the recording medium S both during the forward movement in which the carriage 12 moves from the home position toward an end portion (hereinafter referred to as a full-position) on the opposite side and during the return movement in which the carriage 12 returns from the full-position to the home position side.

Also, in the printer 1 in this embodiment, in a state where the recording head 8 is moved up to above the capping member 21 (one type of a liquid receiving section) at the home position or an ink receiving section 23 (one type of a liquid receiving section) provided on the platen 16 at the full-position on the opposite side to the home position during printing, whereby the nozzle face faces the capping member 21 or the ink receiving section 23, flushing is carried out toward these liquid receiving sections. With the flushing, for the purpose of restoring ejection characteristics (an amount or flight velocity of ejected ink) lowered due to thickening of ink or retention of air bubbles to a design target value, thickened ink or air bubbles are forcibly ejected from the nozzles and removed. Therefore, the flushing is one type of an ejection capability restoration process.

Next, the configuration of the recording head 8 will be described with reference to FIG. 3.

The recording head 8 includes the case 28, a vibrator unit 29 which is stored in the case 28, a flow path unit 30 which is bonded to the bottom face (leading end face) of the case 28, and the like. The case 28 is made of, for example, an epoxy group resin and in the inside thereof, the storage hollow portion 31 for storing the vibrator unit 29 is formed. The vibrator unit 29 includes the piezoelectric vibrator 32 which functions as one type of a pressure generation section, a fixed plate 33, to which the piezoelectric vibrator 32 is bonded, and a flexible cable 34 for supplying a driving signal or the like to the piezoelectric vibrator 32. The piezoelectric vibrator 32 is a piezoelectric vibrator of a longitudinal vibration mode (electric field transverse effect type) which is a lamination type made by carving a piezoelectric plate, in which a piezoelectric body layer and an electrode layer are alternately stacked, into a comb-tooth shape and can extend or contract in a direction perpendicular to the lamination direction (an electric field direction). Also, the temperature sensor 9 is attached to an inner wall surface of the case 28 between the fixed plate 33 and a vibration plate 38 in the storage hollow portion 31.

The flow path unit 30 is constituted by bonding the nozzle plate 37 to a face on one side of a flow path substrate 36 and bonding the vibration plate 38 to a face on the other side of the flow path substrate 36. At the flow path unit 30, a reservoir 39 (a common liquid chamber), an ink supply port 40, a pressure chamber 41, a nozzle communication port 42, and a nozzle 43 are provided. Then, a successive ink flow path which extends from the ink supply port 40 to the nozzle 43 through the pressure chamber 41 and the nozzle communication port 42 is formed corresponding to each nozzle 43.

The nozzle plate 37 is a member, in which a plurality of nozzles 43 is perforated in rows at a pitch (for example, 180 dpi) corresponding to the dot formation density, and in this embodiment, it is made of stainless steel, for example. Also, the nozzle plate 37 is sometimes made of a silicon single-crystal substrate. The vibration plate 38 has a double structure in which an elastic body film 46 is laminated on the surface of a support plate 45. In this embodiment, the vibration plate 38 is made by using a composite plate material in which a stainless plate that is one type of a metal plate is used as the support plate 45 and a resin film as the elastic body film 46 is laminated on the surface of the support plate 45. At the vibration plate 38, a diaphragm portion 47 which changes the volume of the pressure chamber 41 is provided. Also, at the vibration plate 38, a compliance portion 48 which seals a portion of the reservoir 39 is provided.

The diaphragm portion 47 is made by partially removing the support plate 45 by an etching process or the like. That is, the diaphragm portion 47 is composed of an island portion 49, to which a leading end face of a free-end portion of the piezoelectric vibrator 32 is bonded, and a thin-walled elastic portion 50 surrounding the island portion 49. The compliance portion 48 is made by removing the support plate 45 of an area facing the opening face of the reservoir 39 by an etching process or the like similarly to the diaphragm portion 47 and functions as a damper which absorbs pressure fluctuation of the liquid stored in the reservoir 39.

Then, since the leading end face of the piezoelectric vibrator 32 is bonded to the island portion 49, the volume of the pressure chamber 41 can be varied by extending and contracting the free-end portion of the piezoelectric vibrator 32. Pressure fluctuation occurs in the ink in the pressure chamber 41 in accordance with the volume variation. Then, the recording head 8 is made so as to eject an ink droplet from the nozzle 43 by using the pressure fluctuation.

Figure 4A:
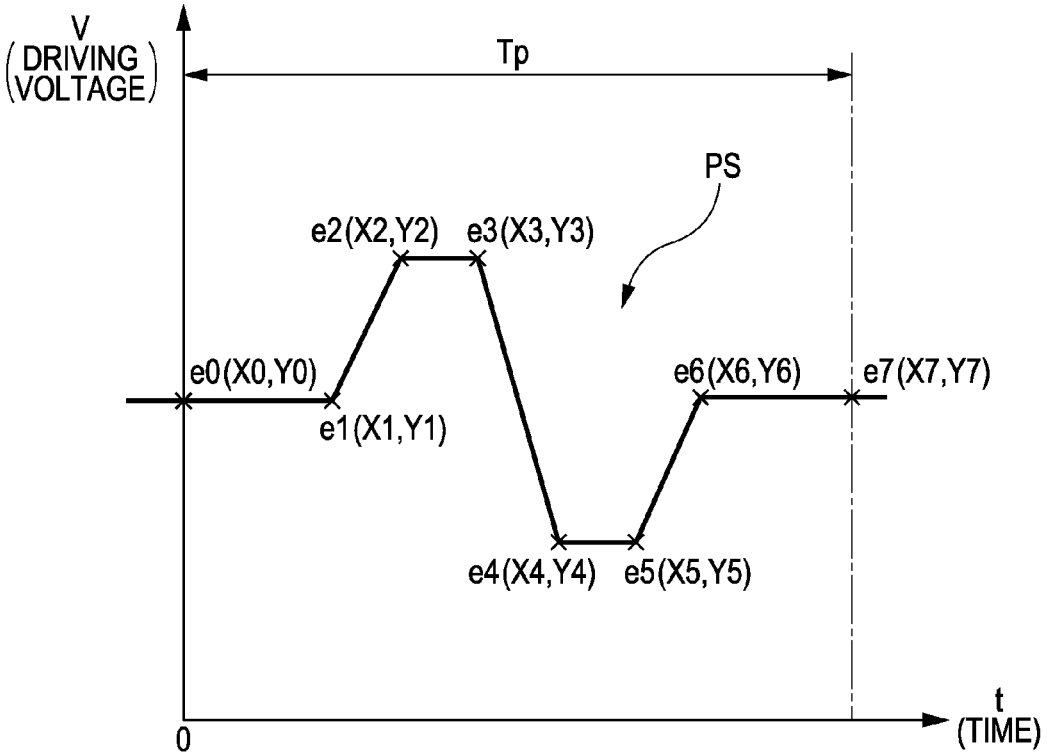
FIGS. 4A and 4B are waveform diagrams explaining the configuration of an ejection pulse in accordance with an embodiment.
Figure 4B:
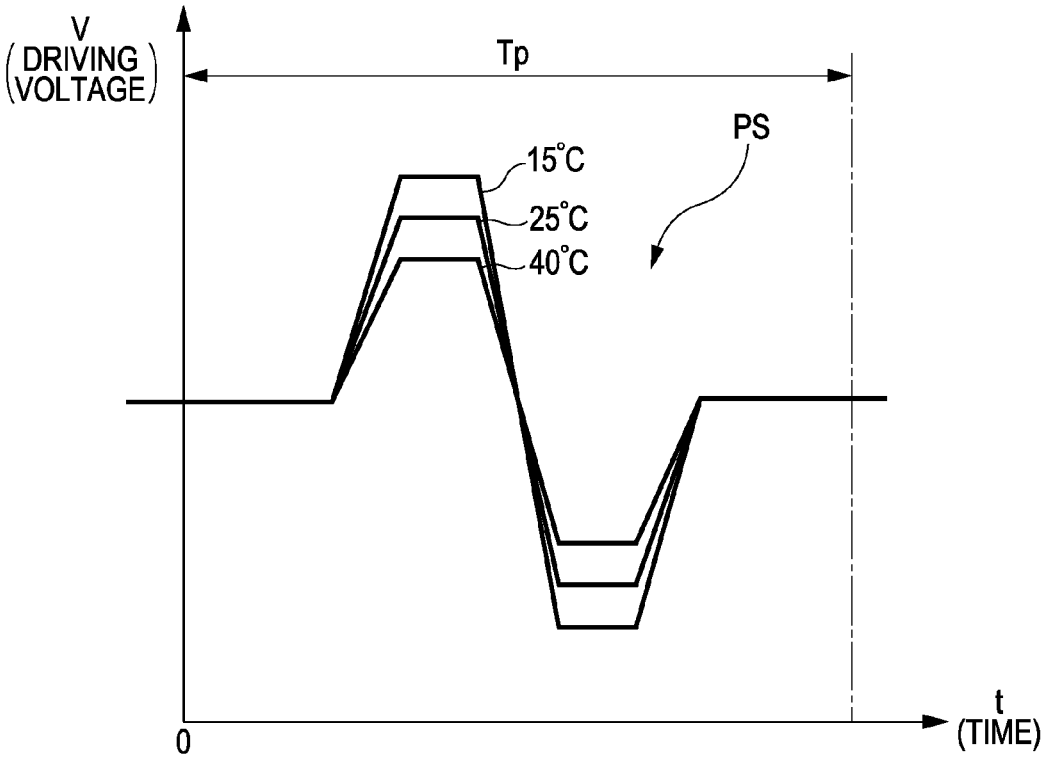

FIGS. 4A and 4B are diagrams explaining a waveform example of the ejection pulse PS which is included in the driving signal COM which is generated by the driving signal generation circuit 4. The driving signal COM is repeatedly generated from the driving signal generation circuit 4 every unit period that is a repetition period. The unit period corresponds to a period in which the nozzle 43 moves by a distance corresponding to one pixel of the image or the like which is printed on the recording medium S. For example, in a case where the print resolution is 720 dpi, a unit period T is equivalent to a period in which the nozzle 43 moves 1/720 inch with respect to the recording medium S. Then, in this unit period, at least one or more of period Tp, which generates the ejection pulse PS, is included. That is, in the driving signal COM, at least one or more of ejection pulse PS is included. In addition, the shape of the ejection pulse PS is not limited to the illustrated shape and various waveforms are adopted in accordance with the amount of ink or the like which is ejected from the nozzle 43.

In FIG. 4A, the coordinates e0 to e7 in the respective points of the waveform of the ejection pulse PS are shown. When the driving signal COM is generated, coordinate data which defines time and voltage relating to the waveform of such a driving signal is sent from the printer controller 7. That is, an X in the coordinate data expresses a time (elapsed time) when the e0 is set to be the origin (a base point), and a Y expresses voltage (electric potential) in the time. The driving signal generation circuit 4 performs interpolation on coordinate points on the basis of the sent coordinate data, thereby generating a driving signal having a waveform in which the coordinates of each coordinate data are connected to each other. That is, if each coordinate data which is sent from the printer controller 7 is changed, the waveform of the ejection pulse also changes accordingly.

For example, when an increase in the amplitude of the ejection pulse is desired, the values of voltage Y2 at the e2 and voltage Y3 at the e3 are increased and the values of voltage Y4 at the e4 and voltage Y5 at the e5 are lowered. By doing so, since the amplitude of the ejection pulse becomes large, the applied displacement of the piezoelectric vibrator 32 becomes larger. Also, when a reduction of the amplitude of the ejection pulse is desired, the values of the voltage Y2 at the e2 and the voltage Y3 at the e3 are reduced and the values of the voltage Y4 at the e4 and the voltage Y5 at the e5 are increased. By doing so, since the amplitude of the ejection pulse becomes small, the applied displacement of the piezoelectric vibrator 32 is decreased. Then, it is possible to generate a desired ejection pulse. Also, it is also possible to change a gradient of a change in electric potential without changing the voltage. For example, it is possible to make a gradient of the change in electric potential steep by making the value of a time X1 at the e1 large or making the value of a time X4 at the e4 small. As a result, the applied displacement of the piezoelectric vibrator 32 becomes steeper. Conversely, it is possible to make a gradient of a change in electric potential gentle by making the value of the time X1 at the e1 small or making the value of the time X4 at the e4 large. As a result, the applied displacement of the piezoelectric vibrator 32 becomes gentler.

Incidentally, ink which is used in this embodiment changes in viscosity in accordance with the temperature thereof. If the viscosity of ink is low, an ink droplet is easily ejected from the nozzle. However, if the viscosity of ink becomes high, it is hard for an ink droplet to be ejected from the nozzle. For this reason, if the temperature of ink is different, in a case where the same driving signal (ejection pulse) is applied to the piezoelectric vibrator 32, the ejection amount of an ink droplet becomes different. Specifically, even in a case where an ejection pulse having the same waveform is applied to the piezoelectric vibrator 32, if the temperature is high, an ink droplet of a size larger than that when the temperature is low is ejected. In this manner, if an ejection amount of an ink droplet differs according to the temperature, the density of an image which is formed on the recording medium S changes in accordance with the temperature. In the printer 1 in this embodiment, since the heating of the platen heater 10 is started along with switching-on, heat from the platen heater 10 is transmitted to the recording head 8, whereby the viscosity of ink changes. Specifically, the viscosity is reduced.

Figure 5:
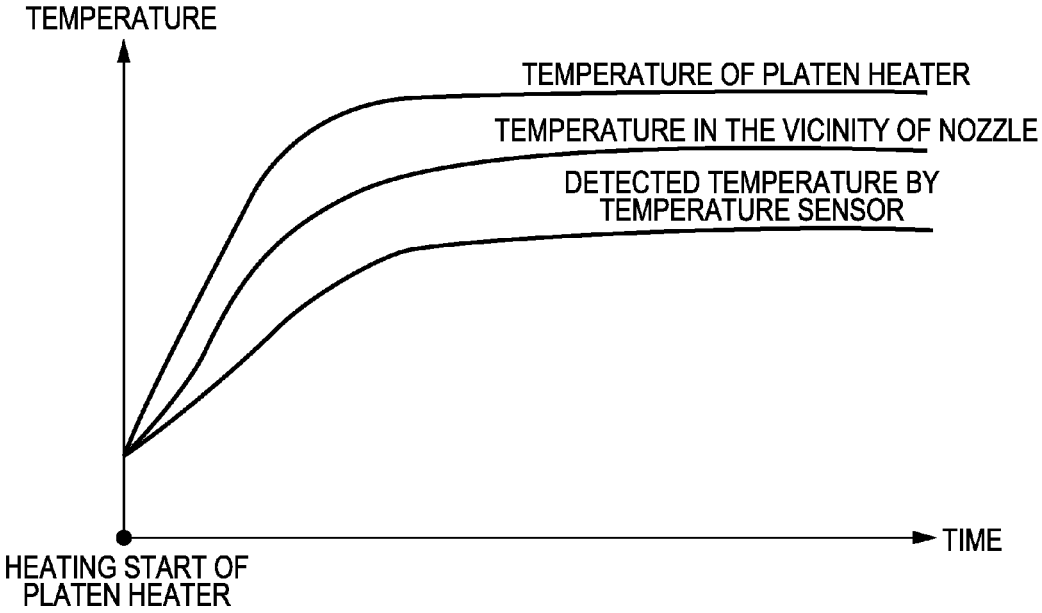
FIG. 5 is a graph showing changes in the temperature of a platen heater, the temperature in the vicinity of a nozzle of the recording head, and the temperature detected by a temperature sensor, in accordance with an embodiment.

FIG. 5 is a graph showing changes in the temperature of the platen heater 10 after the printer 1 is switched on, a temperature in the vicinity of the nozzles of the recording head 8, and the temperature which is detected by the temperature sensor 9. As shown in this drawing, due to the heat from the platen heater 10, the temperature of the inside of the recording head 8 rises with time from a relatively low state at the time of switching-on. In addition, in a configuration in which a disposition position of the temperature sensor 9 is at a position distant from the nozzle 43, the temperature of the ink in the vicinity of the nozzle 43 has a tendency to be higher than the temperature which is detected by the temperature sensor 9. Since until the temperature (the detected temperature by the temperature sensor 9) of the inside of the recording head 8 becomes a steady state or close to a steady state, the viscosity of ink changes considerably, a change in density of an image can occur easily.

In order to prevent such a problem, in the printer 1 of this embodiment, a configuration is made such that during a printing process, in a case where a detected temperature by the temperature sensor 9 has exceeded a predetermined temperature range, the printing process is stopped temporarily. Hereinafter, an explanation will be made regarding this point.

Figure 6:
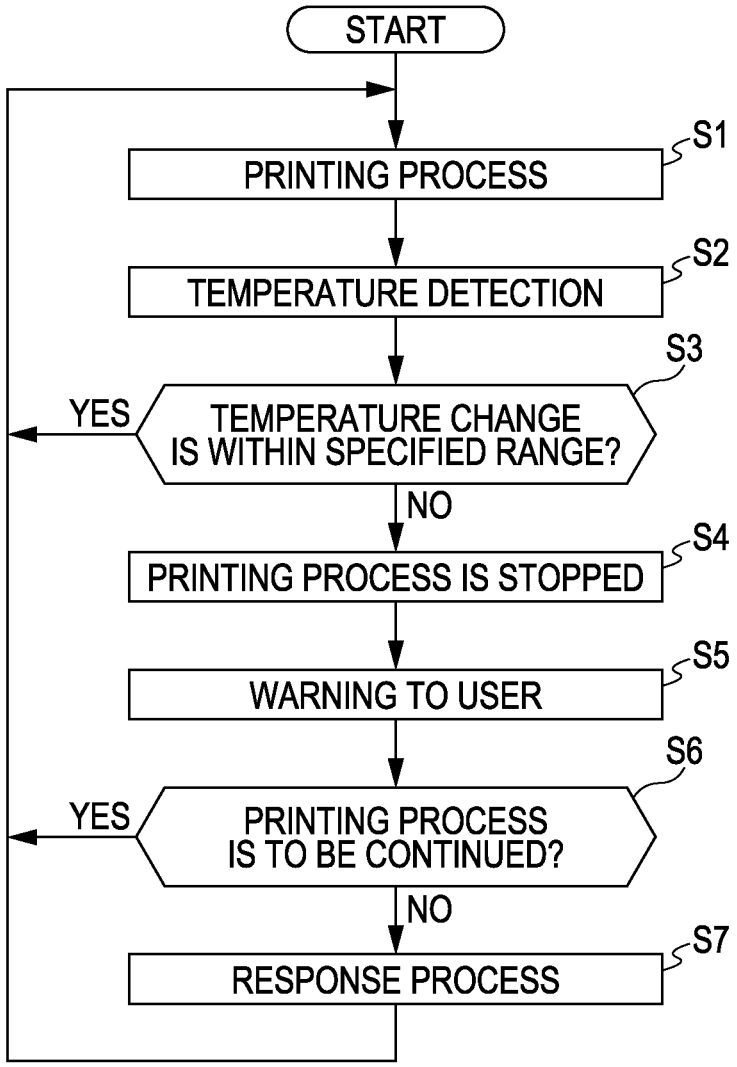
FIG. 6 is a flowchart explaining the processes of the printer of FIG. 1, in accordance with an embodiment.

FIG. 6 is a flowchart explaining the processes of the printer 1.

If the printing process is started, the recording head 8 which was waiting at the home position starts to move toward the full-position side. Acceleration until the recording head 8 reaches a constant velocity is completed outside the printing area. In the printing area, that is, an area which corresponds to the recording medium S placed on the platen 16, the recording head 8 ejects ink from the nozzle 43 by applying the ejection pulse PS which is included in the driving signal COM to the piezoelectric vibrator 32 on the basis of the printing data while moving at a constant velocity, thereby printing an image or the like on the recording medium S (S1). Then, if the recording head 8 moves further outside the printing area, the recording head 8 changes the movement direction thereof to the opposite direction and then ejects ink from the nozzle 43 in the printing area while moving toward the home position side, thereby printing an image or the like on the recording medium S. In the middle of such a printing process, the printer controller 7 performs temperature detection by the temperature sensor 9 (S2). With regard to the frequency with which the temperature detection is performed, it can be arbitrarily set. However, before the detected temperature by the temperature sensor 9 becomes a steady-state value, the detection may be performed on the basis of the degree of a change in density of the recorded image accompanying a change in temperature. Specifically, the value of a color difference ΔE (a color difference about the painted-out portion when supposing that the same area on the same recording medium is painted out by the same ink in the same ejection pulse) in a L*a*b* color system which is a color display method which is defined in JISZ8729 is determined to be an interval which does not exceed 1 at the time of the previous detection and the time of the next detection. The color system expresses a color by three indexes, an L* value representing brightness, an a* value (RG chroma) representing the degree of red or green, and a b* value (YB chroma) representing the degree of yellow or blue. In ink which is used in the printer 1 of this embodiment, if the detected temperature changes by 3° C., since there is the possibility that the color difference ΔE may exceed 1, a setting is made such that temperature detection is performed before the change in temperature exceeds 3° C. In addition, the color difference ΔE is expressed by the following expression (1).

$$\Delta E=\sqrt{(\Delta L^{*2}+\Delta a^{*2}+\Delta b^{*2})}=1 \quad (1)$$

In addition, with regard to a correspondence relationship between the color difference ΔE and a detected temperature, it can be grasped by performing the painting-out under at least two or more different temperatures and then performing color measurement.

In this embodiment, temperature detection by the temperature sensor 9 is performed either at a point in time (the recording head slows down outside the printing area) when the recording head 8 has moved to the outside of the printing area before or after the printing area, or a point in time when the recording head has temporarily stopped when reversing the direction thereof. By performing temperature detection at the timing when the recording head 8 is outside the printing area and movement has been stopped, superposition of noise on a detection signal is prevented. As a result, it is possible to detect a more precise temperature. In addition, as noise which is superposed on a detection signal by the temperature sensor 9, noise accompanying vibration at the time of the movement of the recording head 8 (at the time of the movement of the platen 16 in the case of a configuration in which the position of the recording head 8 is fixed and the platen 16 is moved) or noise from a motor or the like of the movement mechanism for carriage 3 can be considered. Therefore, by performing temperature detection at a point in time when the recording head 8 has stopped, it is possible to reduce or prevent these effects. In addition, as the temperature detection timing, it is preferable if detection is performed in the period after the recording head 8 moves relatively with respect to the platen 16, thereby coming outside the printing area and before the recording head 8 enters into the printing area again with a relative movement direction reversed. Accordingly, the driving signal generation circuit 4 performs generation of a driving signal in the period before the recording head 8 enters the printing area.

Next, the printer controller 7 determines whether or not the temperature detected by the temperature sensor 9 is within a predetermined range (S3). The decision is performed by comparing the difference (temperature variation) between the temperature detected at the previous time and the temperature detected at this time with a predetermined allowable variation. In this embodiment, the allowable variation is set to be 3° C. Then, in a case where a decision is made that the detected temperature is within the predetermined range, the process returns to the S1 and printing is resumed. In addition, the temperature detected by the temperature sensor 9 is stored in a nonvolatile storage portion of the memory 26. However, in a case where in the S3, a decision is made that the detected temperature is within the predetermined range, the detected temperature at this time is not stored in the nonvolatile storage portion of the memory 26 and the detected temperature at the previous time is used in the comparison at the time of the next decision without change. On the other hand, in a case where in the S3, a decision is made that the detected temperature exceeds the predetermined range, the printer controller 7 stops printing (S4). Then, in this embodiment, the printer controller 7 performs warning to a user by displaying a message that the detected temperature exceeds the predetermined range, through a display device or the like which serves as a selection request section in the invention and is provided at the computer CP connected to the printer 1 or the printer 1 (S5), and prompts selection of whether or not printing is to be continued after the stopping of printing is cancelled (S6). In a case where the instructions of the intent to continue printing have been received from a user, the process returns to the S1 and printing is resumed. In this manner, by performing a selection request to a user, it becomes possible to cancel the stopping of printing and then continue printing at the user's discretion in a case where a user wants to finish printing quickly in spite of some problems in the shading of images, a case where a user determines that the printing is of a purpose in which the shading of images does not matter, or the like. On the other hand, in a case where the instructions of the intent not to continue printing has been received from a user, the printer controller 7 executes a response process (S7).

In addition, the decision of whether "a change in temperature is within the predetermined range" in the S3 can be replaced with the decision of whether "the temperature is within the predetermined range", or the decision of whether "at least one of a change in temperature or a temperature is within the predetermined range". In the case of the decision of whether "a temperature is within the predetermined range", for example, it is decided whether "a detected temperature is in the range of 20° C. to 28° C.". When it is found that if it is a temperature within the range, even if the driving signal is the same, an ejection amount or the like of ink does not significantly change and printed-image quality is almost the same, a decision may be made with the temperature itself rather than with a change in temperature. A decision may be made by either one of a change in temperature or the temperature. If both a change in temperature and the temperature are within a constant range, more exact control of an ejection amount or the like becomes possible.

Also, before the stopping of printing (between the S3 and the S4), it is also possible to make a request to a user for the selection of whether or not printing is continued without the stopping of printing and continue printing without the stopping of printing in a case where a user gives the instructions of intent to continue printing. In doing so, in a case where a user wants to finish printing quickly in spite of some problems in the shading of images, a case where a user determines that the printing is of a purpose in which the shading of images does not matter, or the like, it is possible to continue printing without the stopping of printing, reflecting the demands of the user.

In this embodiment, as the above-mentioned response process, correction of the ejection pulse PS is performed in accordance with the temperature detected by the temperature sensor 9. In the memory 26 of the printer controller 7, a correction formula is stored which defines the amounts of change in the coordinates e0 to e7 in the respective points of a waveform element constituting the ejection pulse PS with respect to the detected temperature of the temperature sensor 9. That is, the ejection pulse PS that the driving signal generation circuit 4 generates in the subsequent printing process is corrected on the basis of the detected temperature and the correction formula.

FIG. 4B is a diagram for explaining the ejection pulse PS which is changed in accordance with the detected temperature of the temperature sensor 9. In the drawing, the ejection pulse PS which is generated when the detected temperature is 15° C., the ejection pulse PS which is generated when the detected temperature is 25° C., and the ejection pulse PS which is generated when the detected temperature is 40° C. are shown. The usage temperature range of the printer 1 is 5° C. to 45° C. As shown in the drawing, setting is made such that compared to the amplitude of the ejection pulse PS in a case where the temperature is low (15° C.), the amplitude of the ejection pulse PS when the temperature is higher (25° C.) is small, and at 40° C., the amplitude is even smaller. In solvent-based ink, if a temperature becomes high within the usage temperature range, viscosity becomes low, and it is preferable if the amplitude of a driving voltage is lowered accordingly. That is, the higher the temperature which is detected by the temperature sensor 9, the more the driving signal generation circuit 4 which functions as an ejection pulse generation section lowers the driving voltage of the ejection pulse PS. Then, the driving signal generation circuit 4 generates the driving signal COM which includes an ejection pulse according to the detected temperature. In this way, in the period before the detected temperature of the temperature sensor 9 enters a steady state or is close to a steady state, temperature detection and correction of an ejection pulse are performed every time the recording head 8 moves outside the printing area. If the response process is ended, an ejecting process is resumed by using the corrected ejection pulse. Accordingly, the viscosity of liquid changes according to a change in temperature, so that variation in the ejection characteristics accompanying a change in temperature, such as changing of the ejection amount of liquid in the case of the same driving signal, can be suppressed. As a result, variation in density of an image or the like which is printed on the recording medium S is suppressed. In particular, after the printer 1 is powered on, the platen heater 10 starts heating, and then, before the temperature of the platen heater 10 or the recording head 8 reaches a steady state, even at a point in time when a rapid change in temperature occurs, it is possible to prevent variation in color tone of an image or the like despite a rapid change in temperature until the detected temperature reaches a steady state. Therefore, for example, in a case where an advertisement or the like is partially printed on a recording medium such as a resin film and a continuous advertisement or the like is finally made into a single sheet by joining the respective parts together, it is possible to reduce the difference in density of an image at the boundary portion of each part.

Then, after the detected temperature by the temperature sensor 9 has become a steady state or a state close to a steady state, the temperature detection or the like may be continuously performed with the above frequency and detection frequency may be reduced. In addition, concerning the correction of the ejection pulse PS on the basis of the detected temperature of the temperature sensor 9, it is also acceptable to estimate a temperature in the vicinity of the nozzle from the detected temperature of the temperature sensor 9 and perform the correction of the ejection pulse PS on the basis of the estimated temperature.

In this manner, in a case where although a change in temperature of the recording head 8 detected by the temperature sensor 9 is present, at least one of a change in temperature or the temperature does not exceed a predetermined range, the printer controller 7 may change (correct) a driving signal (the ejection pulse PS) in accordance with the detected temperature. As a result, it is possible to maintain an almost constant image density or the like without a significant change in liquid ejection characteristics, with the changing of a driving signal without the stopping of printing. In the changing of a driving signal, it is preferable if printing is stopped in a case where an almost constant image density or the like cannot be maintained.

Next, a second embodiment of the invention will be described.

In this embodiment, it is different from the above-described first embodiment in that a flushing process (FL) is carried out as the response process (S7). Since the other points are the same as those in the first embodiment, an explanation thereof is omitted. The flushing process is to move the recording head 8 up to above the capping member 21 at the home position or the ink receiving section 23 provided at the full-position on the opposite side to the home position and then eject (ejection for ejection capability restoration not related to ejection for printing onto the printing medium S) ink from all of the nozzles 43 toward these liquid receiving sections, as described above. By performing the flushing process, new ink having a temperature within a predetermined range or a temperature close to a temperature within a predetermined range is introduced from an ink supply source such as an ink cartridge into an ink flow path in the recording head 8, thereby replacing some or all of the ink in the vicinity of the nozzle 43 therewith. As a result, since it is possible to bring the viscosity of ink in the vicinity of the nozzle 43 close to the viscosity at a point in time of the start of printing, it is possible to suppress a variation in ejection characteristics accompanying an increase in temperature even in a case where printing is resumed subsequently. In addition, after the flushing process is carried out, temperature detection is performed again by the temperature sensor 9, then, after the detected temperature is stored in the memory 26, printing is resumed (S1). Also, a configuration may be made such that the temperature is lowered by ejecting ink from the nozzles 43 toward the liquid receiving section, separately from printing or flushing.

Next, a third embodiment of the invention will be described.

In this embodiment, it is different from each of the above-described embodiments in that as the response process (S7), the recording head 8 moves outside the printing area, specifically, to the home position or the full-position, and then waits at the position. Since other points are the same as those in the first embodiment, an explanation is omitted. Since at least one of a change in temperature or the temperature of the recording head 8 exceeding a predetermined range is, in many cases, due to a change in temperature or the temperature of the recording head 8 exceeding a predetermined range due to the heat of the platen 16 heated by the platen heater 10, by making the recording head 8 wait outside the printing area, it is hard for the heat from the platen heater 10 to be transmitted to the recording head 8, so that it is possible to lower the temperature of the ink in the recording head 8. Also, the ink can be prevented from being erroneously ejected onto the recording medium S during waiting. Then, during the waiting of the recording head 8 outside the printing area, the printer controller 7 repeats temperature detection by the temperature sensor 9 with a predetermined frequency and keeps waiting until a predetermined allowable temperature is attained. In a case where a detected temperature has become equal to or less than an allowable temperature, after the detected temperature is stored in the memory 26, the printing process is automatically resumed (S1). In this manner, by making the recording head 8 wait outside the printing area, it is possible to prevent an increase in the viscosity of ink. As a result, even in a case where the ejection process is subsequently resumed, it becomes possible to suppress variation in the ejection characteristics accompanying a change in temperature.

In such a case, besides waiting for a temperature to be within a predetermined range, the manner of waiting for a change in temperature to return to a temperature in a predetermined range or the manner waiting for one or both to be satisfied is also acceptable.

In addition, the invention is not to be limited to each embodiment described above and various modifications can be made on the basis of the statement of the claims.

In the above-described embodiments, as the pressure generation section, the piezoelectric vibrator 32 of a so-called longitudinal vibration type has been illustrated. However, it is not limited thereto and it is also possible to adopt, for example, a piezoelectric element of a so-called flexural vibration type. In this case, concerning the ejection pulse PS illustrated in the above-described embodiments, it has a waveform in which the direction of the change in electric potential, that is, up-and-down is reversed.

Further, the pressure generation section is not limited to the piezoelectric vibrator and the invention can also be applied to the cases of using various pressure generation sections such as a heat generation element which generates air bubbles in the pressure chamber, and an electrostatic actuator which changes the volume of the pressure chamber by using an electrostatic force.

Also, in the above description, the ink jet type printer 1 that is one type of the liquid ejecting apparatus has been taken and described as an example. However, the invention can also be applied to a liquid ejecting apparatus which is provided with a heater heating a recording medium and performs ejection of liquid while moving a recording head with respect to the recording medium. The invention can also be applied to, for example, a display manufacturing apparatus which manufactures a color filter of a liquid crystal display or the like, an electrode manufacturing apparatus which forms an electrode of an organic EL (Electro Luminescence) display, an FED (surface-emitting display), or the like, a chip manufacturing apparatus which manufactures a biochip (a biochemical element), or a micropipette which supplies a very small amount of sample solution in a precise amount.

What is claimed is:

1. A liquid ejecting apparatus comprising:

an ejecting head having liquid-ejecting nozzles;

a platen disposed to support a recording medium and face the ejecting head;

a heater that heats the platen;

a temperature sensor to detect a temperature of the ejecting head; and a control section that:

supplies a driving signal, which causes liquid to be ejected from the nozzles, and supplies a heater control signal, which controls the heater, wherein the heater control signal is separate from the driving signal;

wherein, if at least one of a change in temperature of the ejecting head or the temperature of the ejecting head that exceeds a predetermined range is detected by the temperature sensor, the control section stops ejection of liquid for printing from the nozzles.

2. The liquid ejecting apparatus of claim 1, wherein in a case where at least one of a change in temperature of the ejecting head or the temperature of the ejecting head detected by the temperature sensor does not exceed the predetermined range, the control section supplies the driving signal, wherein the driving signal comprises a driving waveform, which is configured in accordance with the detected temperature, that causes liquid for printing to be ejected from the nozzles.

3. The liquid ejecting apparatus of claim 1, wherein the control section performs ejection control of the liquid by ejecting non-printing liquid, after the control section stops ejection of the liquid for printing from the nozzles.

4. The liquid ejecting apparatus of claim 1, wherein the ejecting head is controlled so as to wait outside of a printing area after ejection of the liquid for printing from the nozzles is stopped by the control section.

5. The liquid ejecting apparatus of claim 1, further comprising: a selection request section that, after ejection of the liquid for printing from the nozzles is stopped by the control section, makes a request to a user for selection of whether or not printing is to be restarted.

6. The liquid ejecting apparatus of claim 1, further comprising:

a selection request section that, before ejection of the liquid for printing from the nozzles is stopped by the control section, makes a request to a user for selection of whether or not printing is to be continued without said stopping of liquid ejection for printing from the nozzles by the control section.

7. A control method of a liquid ejecting apparatus, which includes an ejecting head having liquid-ejecting nozzles; a platen disposed to support a recording medium and face the ejecting head; a heater that heats the platen; a temperature sensor that detects a temperature of the ejecting head; and a control section that supplies a driving signal that causes the liquid to be ejected from the nozzles, and a heater control signal that controls the heater, wherein the heater control signal is separate from the driving signal, the method comprising:

determining whether or not at least one of a change in temperature of the ejecting head or a temperature of the ejecting head detected by the temperature sensor has exceeded a predetermined range; and stopping ejection of the liquid for printing from the nozzles if it is determined that at least one of the change in temperature of the ejecting head or the temperature of the ejecting head is outside the predetermined range using the driving signal.

8. The method of claim 7, wherein the temperature of the ejecting head is detected when the ejecting head is not moving relative to the platen.

9. The method of claim 8, further comprising generating a pulse correction in response to the detected temperature, the pulse correction being used to generate a driving waveform of the driving signal, wherein the driving waveform is used to cause liquid to be ejected from the nozzles.

10. The method of claim 7, further comprising generating a pulse correction in response to the detected temperature, the pulse correction being used to generate a driving waveform of the driving signal, wherein the driving waveform is used to cause liquid to be ejected from the nozzles.

11. The method of claim 7, further comprising requesting input from a user as to whether to restart ejection of the liquid for printing from the nozzles after said stopping ejection of the liquid for printing from the nozzles.

12. The method of claim 7, further comprising:

when the temperature detected by the temperature sensor is determined to exceed the predetermined range, moving the ejecting head relative to the platen to a position where the ejecting head is substantially isolated from the heat generated by the platen heater; and restarting ejection of the liquid for printing from the nozzles after the temperature of the ejecting head is reduced so as to be within the predetermined range.

13. A method of operation of a liquid ejecting apparatus, the method comprising:

heating a platen disposed to support a recording medium and face an ejecting head having liquid-ejecting nozzles using a heater control signal;

moving the ejecting head relative to the platen;

ejecting liquid from the nozzles onto the recording medium using a driving signal that is separate from the heater control signal;

detecting a temperature of the ejecting head;

determining whether or not at least one of a change in temperature of the ejecting head or a temperature of the ejecting head detected by the temperature sensor has exceeded a predetermined range; and stopping the ejection of liquid from the nozzles if it is determined that at least one of the change in temperature of the ejecting head or the temperature of the ejecting head is outside the predetermined range.

14. The method of claim 13, wherein the temperature of the ejecting head is detected when the ejecting head is not moving relative to the platen.

15. The method of claim 14, further comprising generating a pulse correction in response to the detected temperature, the pulse correction being used to generate a driving waveform of the driving signal, wherein the driving waveform is used to cause liquid to be ejected from the nozzles.

16. The method of claim 13, further comprising generating a pulse correction in response to the detected temperature, the pulse correction being used to generate a driving waveform of the driving signal, wherein the driving waveform is used to cause liquid to be ejected from the nozzles.

17. The method of claim 13, further comprising requesting input from a user as to whether to restart ejection of liquid for printing from the nozzles after said stopping ejection of liquid for printing from the nozzles.

18. The method of claim 13, further comprising:

when the temperature detected by the temperature sensor is determined to exceed the predetermined range, moving the ejecting head relative to the platen to a position where the ejecting head is substantially isolated from the heat generated by the platen heater; and restarting ejection of liquid for printing from the nozzles after the temperature of the ejecting head is reduced to within the predetermined range.

19. The method of claim 13, further comprising:

moving the ejecting head relative to the platen to a non-printing position; and while the ejecting head is disposed in the non-printing position, performing a flushing process by ejecting liquid from the nozzles.

20. The method of claim 19, further comprising:

after the flushing process is performed, repeating the detection of a temperature of the ejecting head; and restarting ejection of liquid for printing from the nozzles after the temperature of the ejecting head is reduced to within the predetermined range.

* * * * *